US007023417B2

(12) United States Patent
Bily et al.

(10) Patent No.: US 7,023,417 B2
(45) Date of Patent: Apr. 4, 2006

(54) SWITCHING CIRCUIT FOR COLUMN DISPLAY DRIVER

(75) Inventors: Stephen Bily, Austin, TX (US); Tim Blankenship, Austin, TX (US)

(73) Assignee: Winbond Electronics Corporation, Hsinchu (TW)

( * ) Notice: Subject to any disclaimer, the term of this patent is extended or adjusted under 35 U.S.C. 154(b) by 368 days.

(21) Appl. No.: 10/109,632

(22) Filed: Apr. 1, 2002

(65) Prior Publication Data

US 2002/0158834 A1 Oct. 31, 2002

Related U.S. Application Data

(60) Provisional application No. 60/280,677, filed on Mar. 30, 2001.

(51) Int. Cl.
*G09G 3/36* (2006.01)

(52) U.S. Cl. ..... 345/100; 345/89; 345/99; 315/169.2

(58) Field of Classification Search ..... 345/87, 345/89, 95, 98, 100, 90, 99, 74.1; 315/169.2, 315/169.3; 327/277; 361/152
See application file for complete search history.

(56) References Cited

U.S. PATENT DOCUMENTS 5,189,312 A * 2/1993 Shimizu et al. ..... 327/64
5,376,926 A * 12/1994 Sano ..... 345/89
5,465,054 A 11/1995 Erhart ..... 326/34
5,510,748 A 4/1996 Erhart et al. ..... 327/530
5,528,256 A 6/1996 Erhart et al. ..... 345/96
5,572,211 A 11/1996 Erhart et al. ..... 341/144
5,574,475 A 11/1996 Callahan, Jr. et al. ..... 345/100
5,578,957 A 11/1996 Erhart et al. ..... 327/333
5,604,449 A 2/1997 Erhart et al. ..... 326/81
5,703,617 A 12/1997 Callahan, Jr. et al. ..... 345/98
5,719,591 A 2/1998 Callahan, Jr. et al. ..... 345/98
5,726,676 A 3/1998 Callahan, Jr. et al. ..... 345/98
5,754,156 A 5/1998 Erhart et al. ..... 345/98
5,781,167 A * 7/1998 Rebeschi et al. ..... 345/76
5,818,252 A 10/1998 Fullman et al. ..... 324/765
5,852,426 A * 12/1998 Erhart et al. ..... 345/96
5,929,798 A * 7/1999 Baek ..... 341/153
6,040,815 A 3/2000 Erhart et al. ..... 345/98
6,049,246 A 4/2000 Kozisek et al. ..... 330/9
6,100,879 A * 8/2000 Da Costa ..... 345/211
6,175,346 B1 * 1/2001 Chiu et al. ..... 345/82
6,271,784 B1 * 8/2001 Lynn et al. ..... 341/150
6,366,226 B1 * 4/2002 Broekaert ..... 341/133
6,396,217 B1 * 5/2002 Weindorf ..... 315/169.1
6,411,273 B1 * 6/2002 Nakamura et al. ..... 345/98
6,448,948 B1 * 9/2002 Friedman ..... 345/74.1

* cited by examiner

*Primary Examiner*—Amr A. Awad
*Assistant Examiner*—Abbas I. Abdulselam
(74) *Attorney, Agent, or Firm*—Finnegan, Henderson, Farabow, Garrett & Dunner, L.L.P.

(57) ABSTRACT

According to the present invention, improved techniques for switching current flow in a display column driver circuit. Embodiments provide switching of analog outputs of digital to analog converters in order to drive columns of an LCD. Embodiments can provide a full range of voltage output to drive an LCD without necessitating a full range amplifier configuration. Further, many embodiments can be realized in smaller space on an IC chip than in conventional technologies.

9 Claims, 6 Drawing Sheets

SWITCHING CIRCUIT FOR COLUMN DISPLAY DRIVER

PRIORITY

Priority is claimed to the following U.S. provisional patent application:

Provisional U.S. Patent Application No. 60/280,677, entitled "Improved Switching Circuit for Column Display Driver," filed on Mar. 30, 2001.

RELATED APPLICATIONS

The following identified U.S. patent applications are relied upon and are hereby incorporated by reference in their entireties in this application.

U.S. Pat. No. 6,771,126, issued on Aug. 3, 2004.

U.S. Pat. No. 6,727,835, issued on Apr. 27, 2004.

TECHNICAL FIELD

The present invention relates generally to a column driver circuit, and, in particular, to a technique for controlling current flow in an analog output of a column driver.

BACKGROUND OF THE INVENTION

The liquid crystal display has become ubiquitous and well known, driven in part by popular applications such as laptop personal computers, car navigational displays, and flat panel displays for personal computers. In each of these applications, a column driver circuit enables the operation of each liquid crystal display unit. Liquid crystal displays comprise a plurality of individual picture elements, called pixels, which are uniquely addressable in a row and column arrangement. The column driver circuitry provides driving voltages to the columns of the liquid crystal display. In a typical application, a 13.3-inch extended graphics array ("XGA") liquid crystal display comprises 1024 3-color columns, for a total of 3072 individual columns. In a representative arrangement, these columns are driven by eight 384-column driver chips.

The physics underlying liquid crystal display technology calls for an alternating polarity in the driving voltage. For example, if a column of the display is driven at +5 volts for a specific period of time, then this same column is driven at −5 volts during the subsequent time interval. In such an arrangement, the peak to peak voltage is 10 volt, but the sum of the individual driving voltages for any given cycle is 0 volt.

Liquid crystal displays ("LCDs") are manufactured in a variety of sizes and display formats. The thin film transistor ("TFT") technology LCDs, in which each picture element, or pixel, is driven by one to four transistors, must be driven with voltages that sum to zero over successive cycles. Failure to so drive the display causes the display device to degrade until it becomes unusable. A variety of methods can be used to drive the LCD at alternating polarities. Polarity inversion comprises switching the polarity of the voltage applied to drive the columns of the LCD over time to obtain an average of approximately 0 volt over time. Exemplary methods for alternating polarities include frame inversion, line inversion, column inversion, and dot inversion.

In frame inversion, each pixel element in the entire panel is driven with a similar polarity in a given frame. In a subsequent frame, each pixel element is driven with a polarity opposite to that used to drive the previous frame.

One characteristic of frame inversion is that the polarity reversal must occur at a sufficient rate in order to reduce "flicker," the appearance of a changing image. This arises due to slight variations in the color and/or intensity of the pixels in the display depending upon the polarity the pixels are driven. Changing the polarity of all pixels in the display at the same time causes the slight variation to occur at once all over the display screen, which can be noticeable to the eye if the rate of change is not quick enough. Frame inversion can have the benefit of lower power consumption and less complex display driver circuitry due to the uniformly timed polarity changes.

The method of line inversion drives all the pixels of every other row (line) in the display at opposite polarities at a given period of time. In a subsequent period of time, every pixel element in every other row is driven with a polarity opposite to that used to drive the row in the previous time period. Line inversion methods provide both temporal and spatial averaging of polarity related pixel variations, giving a more uniform appearance to the display image. Power consumption is greater in embodiments using line inversion than in embodiments using frame inversion. In line inversion methods, the column driver switches the polarity of the voltage applied to the column line at the time that the information displayed on each line is updated.

In the column inversion method, all the pixels of every other column in the display are driven at opposite polarities at a given period of time. In a subsequent period of time, each pixel element in every other column is driven with a polarity opposite to that used to drive the column in the previous time period. In column inversion methods, the column driver switches the polarity of the voltage applied to the column at each successive cycle, and maintains every other column at an opposite polarity. Column inversion methods are characterized by a relatively low power consumption than that provided by line inversion methods. Further, column inversion methods can provide superior spatial averaging characteristics due to the larger number of columns than rows in many display geometries.

In the dot inversion method, each individual pixel is driven at an opposite polarity from its neighbor, both along the row and along the column directions at a given period of time. In a subsequent period of time, each pixel is driven with a polarity opposite to that used to drive the pixel in the previous time period. Dot inversion methods are characterized by a relatively superior spatial averaging because the polarity of each pixel is switched at an opposite cycle from that of its neighbors. Power consumption is greater using dot inversion than using frame or column inversion methods. In dot inversion methods, like in line inversion methods, the column driver switches the polarity of the voltage applied to the column line at the time that the information displayed on each line is updated. Further, in dot inversion methods, like in column inversion methods, the column driver switches the polarity of the voltage applied to the column at each successive cycle, and maintains every other column at an opposite polarity.

A variety of methods can also be used to apply voltage to the LCD in various embodiments such as common voltage modulation and direct drive. In the common voltage modulation, or "VCOM modulation," the common voltage supply to the LCD is changed in order to switch the polarity of the driving voltage. For example, in the positive polarity region of the cycle, the VCOM voltage is set to 0 volt. The LCD voltage ("VLCD"), i.e., the voltage applied by the column driver to each of the columns, ranges from 0 volt to 5 volts, for example, applying a voltage of positive polarity of up to 5 volts to the LCD. In the negative polarity region, the VCOM voltage is set to 5 volts. The VLCD voltage ranges from 0 to 5 volts, as in the previous cycle. The difference between these voltages applies a negative polarity voltage of between 0 and −5 volts to the display. One advantage of the VCOM modulation method is that the driver circuitry only needs to drive the display up to half of the VLCD range in order to obtain a full VLCD range of voltage levels at the display. Thus, in the example where the VLCD ranged from 0 volt to 5 volts, and VCOM alternated between 0 and 5 volts, the total voltage that may be applied to the display is 10 volt, but the drive circuitry need only provide a range of 0 to 5 volts. A disadvantage to the VCOM modulation method is that all of the columns of the display must be driven at the same polarity. Thus, this technique is appropriate only with frame and line inversion drive methods.

In the direct drive method, the common voltage supply to the LCD is held constant. VLCD is varied from the VCOM voltage to the supply voltage. For example, the VCOM voltage may be set to 5 volts. During the positive polarity cycle, the VLCD ranges from 5 volts to 10 volt, providing a range of 0 to 5 volts for the positive half of the cycle. During the negative polarity cycle, the VLCD ranges from 5 volts to 0 volt, providing a range of from 0 to −5 volts for the negative half of the cycle. The total range is 10 volt, from −5 volts to 5 volts. An advantage of direct drive approaches is that the switching is simplified, as the VCOM does not need to be switched. Further, such approaches are readily adaptable to frame, line, column and dot inversion methods described above. One disadvantage is that the column driver circuits need to provide the full range of operating voltages.

One metric for determining characteristics of an arrangement for an LCD is the correlation of error between the difference of the output voltage of the driver and the VCOM of the driver in the positive polarity portion of the cycle, and the error between the difference of the output voltage of the driver and the VCOM in the negative polarity portion of the cycle. It is desirable for these two errors to be correlated. In other words, it is desired that the error in the negative portion of the cycle be of the same magnitude and opposite polarity as the error in the positive portion of the cycle. In this case, the errors are 100% correlated. Less that 100% correlation can induce visually noticeable results in the image.

Column driver circuitry components act as intermediaries between the digital format of the electronics that process information and the analog format of the display that presents the results to the user. Accordingly, the column driver circuitry includes a digital to analog converter component that converts the digital signals of the processing unit, bus, and memory into an analog signal. However, this analog signal must be capable of driving the liquid crystal display. While some arrangements drive the liquid crystal display columns directly from the digital to analog converter, another technique is to use a buffer interposed between the converter and the display in order to provide improved driving characteristics for the display.

While certain advantages to conventional approaches are perceived, opportunities for further improvement exist. For example, in many conventional approaches, switching the amplified signal may require relatively large switching circuitry. Larger circuitry uses substantially more area on the chip, causing increases in cost.

SUMMARY OF THE INVENTION

The present invention provides improved techniques for switching current flow in a display column driver circuit. Embodiments provide switching of analog outputs of digital to analog converters in order to drive columns of an LCD. Embodiments can provide a full range of voltage output to drive an LCD without necessitating a full range amplifier configuration. Further, many embodiments can be realized in smaller space on an IC chip than in conventional technologies.

In an exemplary embodiment, a column driver circuit comprises a voltage reference circuit for generating a plurality of reference voltages, at least one multiplexer, coupled to the voltage reference circuit, responsive to the reference voltages and an output signal from a decoder to provide at least one analog output, an analog selection circuit, coupled to the at least one multiplexer, responsive to the analog output from the at least one multiplexer, and a first amplifier stage, coupled to the analog selection circuit, responsive to an output from the analog selection circuit for providing at least one output.

In another exemplary embodiment, a column driver circuit comprises a voltage divider for generating a plurality of reference voltage levels, a first data decoder coupled to said voltage divider for receiving a first subset of said plurality of reference voltage levels, a second data decoder coupled to said voltage divider for receiving a second subset of said plurality of reference voltage levels, a plurality of digital decoders coupled to said first and second data decoders, operable to select one of said plurality of reference voltage levels for each of said first and second data decoders each to provide at least one analog output, a plurality of amplifiers, each having a first stage that receives said analog output from one of said plurality of data decoders, and a second stage that receives as input an output of said first stage and provides a signal, and a plurality of switches, each coupled between said first stage and said second stage of each of said plurality of two stage amplifiers, wherein one of said switches couples one of said output from one of said first stage of one of said amplifiers to one of one of said second stage of one of said amplifiers.

In yet another exemplary embodiment, a liquid crystal display comprises a plurality of columns of pixels, a plurality of rows of pixels, and a plurality of column driver circuits, each coupled to one of the plurality of pixels, each column driver circuit including, a voltage divider for generating a plurality of reference voltage levels, a first data decoder coupled to said voltage divider for receiving a first subset of said plurality of reference voltage levels, a second data decoder coupled to said voltage divider for receiving a second subset of said plurality of reference voltage levels, at least one digital decoder coupled to said first and second data decoders, operable to select one of said plurality of reference voltage levels for each of said first and second data decoders each to provide at least one analog output, and at least one switch, each of said at least one switch coupled between at least one of said data decoders and at least one amplifier, wherein said at least one switch provide a selection of one of said outputs from at least one of said first and second of data decoders to said at least one amplifier, wherein each of said at least one amplifier has a stage that receives as input said output from one of said first and second data decoders, and provides a signal.

In still another exemplary embodiment, a column driver circuit comprises means for generating reference voltages, means for decoding digital data coupled to said means for generating reference voltages, means for multiplexing the reference voltages and the decoded data coupled to the means for decoding digital data, means for selecting an output of the means for multiplexing coupled to the means for multiplexing, and means for amplifying the selected output coupled to the means for selecting an output.

Embodiments can provide a full range of voltage output to drive an LCD without necessitating a full range amplifier configuration. Further, many embodiments can be realized in smaller space on an IC chip than in conventional technologies.

BRIEF DESCRIPTION OF THE DRAWINGS

It is to be understood that both the foregoing general description and the following detailed description are exemplary and explanatory only and are not restrictive of the invention, as claimed. The accompanying drawings, which are incorporated in and constitute a part of this specification, illustrate possible embodiments of the invention and together with the description, serve to explain the principles of the invention. In the drawings:

DETAILED DESCRIPTION

Devices and methods consistent with the present invention provide improved techniques for switching current flow in a display column driver circuit. Possible embodiments provide switching of analog outputs of digital to analog converters in order to drive columns of an LCD. The present invention may be used when embodied in a wide range of column driver circuit chips having, for example, 6- or 8-bit inputs, and/or in chips capable of driving 240, 384, or 420 columns per chip, and/or in chips having a 9 to 10 volt operating range and/or in chips having a direct drive arrangement for driving the display.

Figure 1:
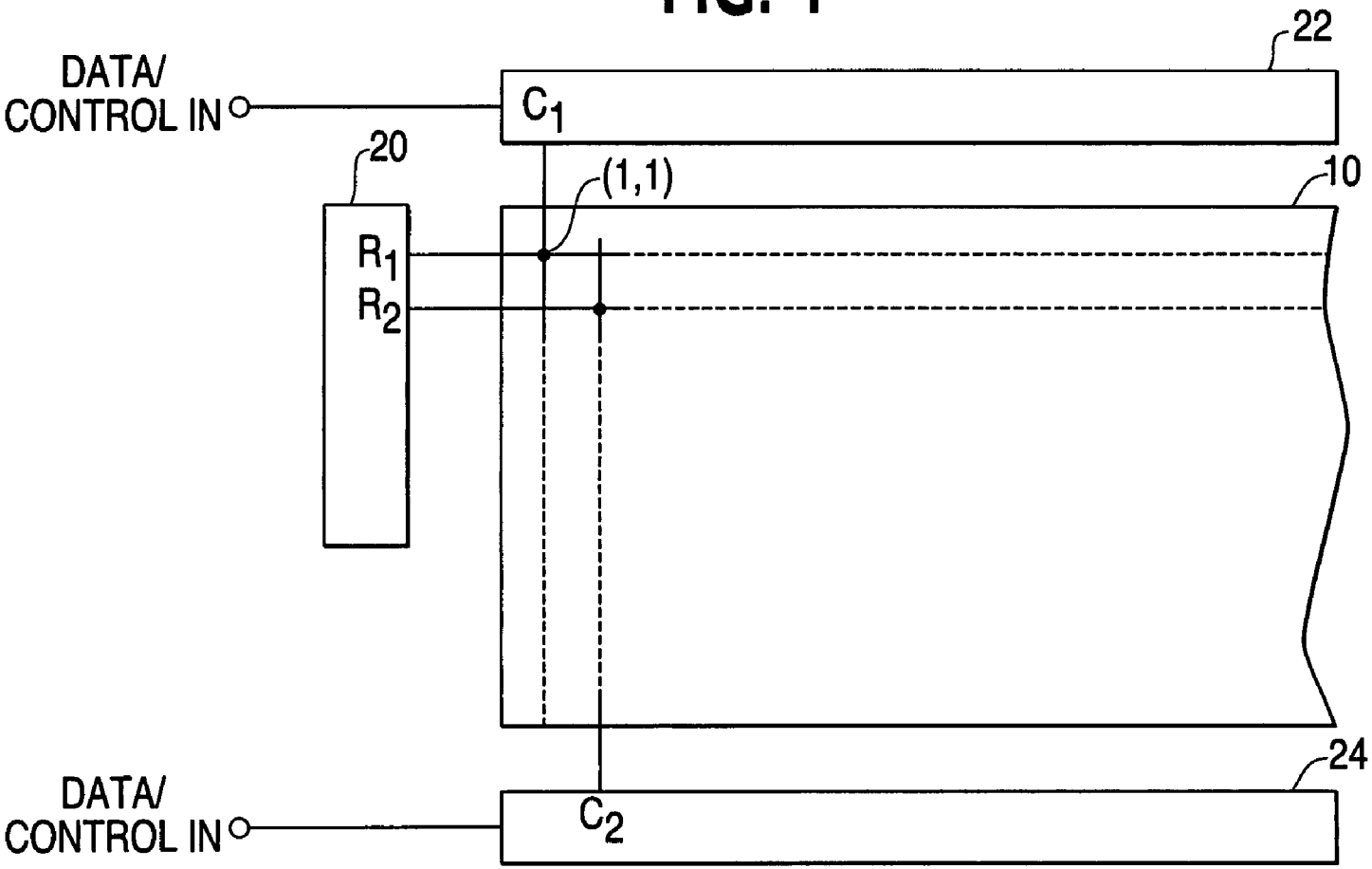
FIG. 1 illustrates a representative display suitable for implementing an embodiment of the present invention.

FIG. 1 illustrates a representative display suitable for implementing an embodiment of the present invention. FIG. 1 illustrates a display 10 of a TFT type, having a plurality of active elements. In one application, display 10 is a 13.3-inch XGA liquid crystal display having 1024 3-color columns, for a total of 3072 individual columns and 768 rows. However, many other configurations of displays and drivers are provided by other possible embodiments. In a representative embodiment, these columns are driven by eight 384-column driver chips, including column driver chips 22 and 24. Exemplary embodiments of the present invention are implemented on such column driver circuit chips. In a representative embodiment, the rows are driven by four 240-row driver chips, including row driver chip 20. Data and control information is provided to column driver circuit chips 22 and 24. As illustrated in FIG. 1, display 10 has a plurality of individually addressable picture elements, or pixels, arranged in row and column format. For example, a first column C1 and a first row R1 control signals drive a plurality of active devices that make up a pixel located at a location (1,1) on display 10. A subsequent column C2 is driven by a second column driver circuit chip 24. The remaining rows and columns of display 10 are driven by column driver chips 22, 24, and other row and column driver circuit chips (not shown). In another embodiment, column driver chips 22 and 24 may be of the type that is implemented, for example, in any one of the devices having the part numbers WFP6815, WFP6615, WFP6616, or WFP6614, which are available from Winbond Electronics Corporation America.

Figure 2:
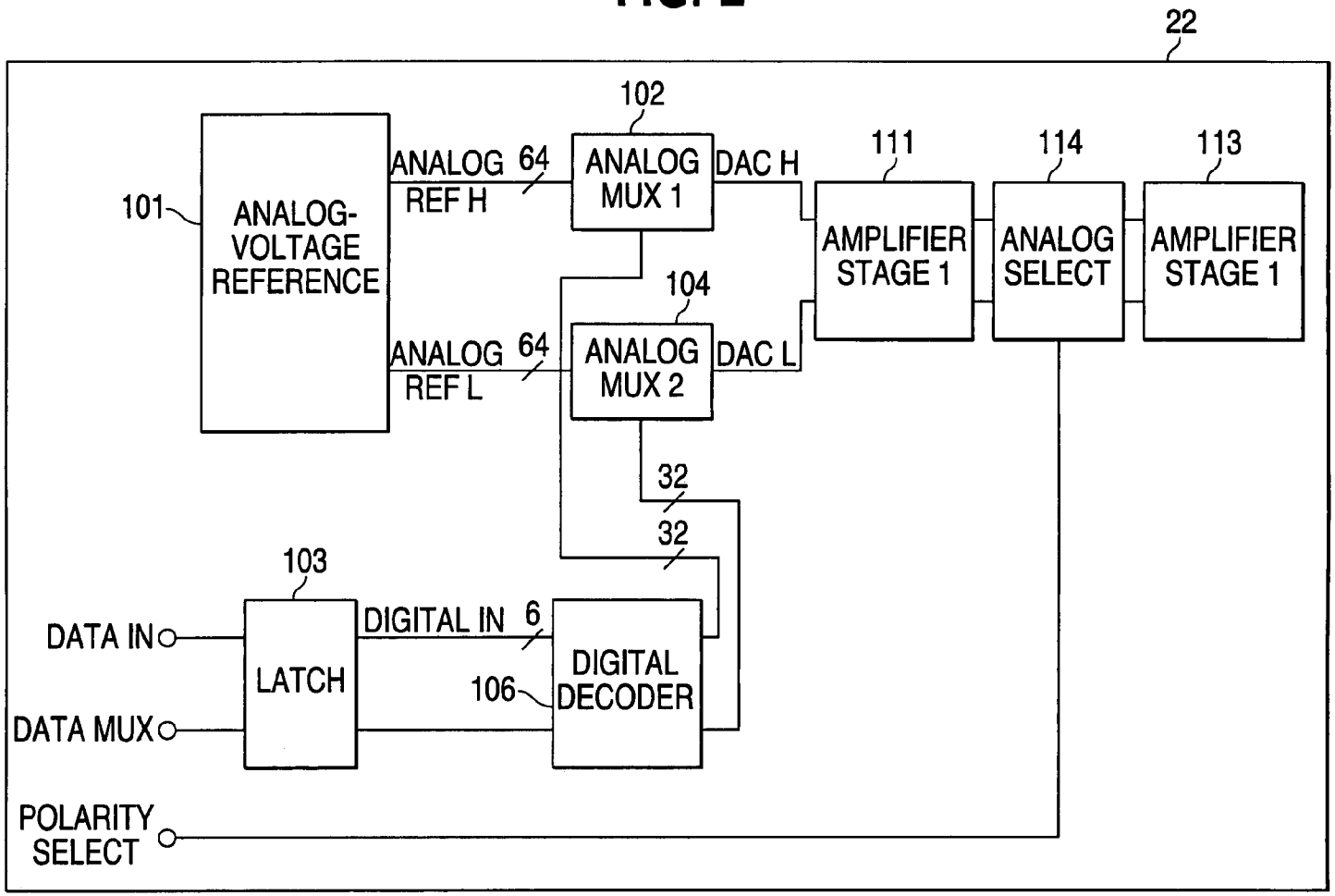
FIG. 2 illustrates a block diagram of a representative column driver circuit in an embodiment of the present invention.

FIG. 2 illustrates a representative column driver circuit in an embodiment of the present invention. As illustrated in FIG. 2, representative column driver 22 comprises an analog voltage reference circuit 101. Analog voltage reference circuit 101 provides a series of reference voltage levels. In an embodiment, analog voltage reference circuit 101 comprises a string of resistive elements connected in series, or "resistive string." However, as will be readily appreciated by those of ordinary skill in the art, other techniques for providing analog reference voltage levels may be used in other embodiments according to the present invention. The reference voltage levels are input to one or more data decoder circuits 102 and 104. Data decoder circuits 102 and 104 are 64:1 analog multiplexers in an embodiment. In alternative embodiments, other topologies can also be used. Each of data decoders 102 and 104 receives a subset of the reference voltage levels from analog voltage reference circuit 101. For example, data decoder 102 receives a high polarity subset of the reference voltage levels, and data decoder 104 receives a low polarity subset of the reference voltage levels.

Digital data input to column driver circuit 22 is latched by a digital latch 103. The latched digital data are provided to a digital decoder 106. Digital decoder 106 is coupled to data decoders 102 and 104. Digital decoder 106 functions to select an appropriate analog voltage from the reference voltage levels input to data decoders 102 and 104 to provide analog outputs DACH and DACL. Analog outputs are provided to a stage-one amplifier 111. The output of stage-one amplifier 111 is input to an analog selection circuit 114, which selects one output from stage-one amplifier 111 as the input to an input of a stage-two amplifier 113. The output voltage from stage-one amplifier 111 may be, for example, one half the available output voltage range. The output from stage-two amplifier 113 drives the columns of the display at opposite polarities. The output voltage from stage-two amplifier 113 may be, for example, the entire available output voltage range.

Figure 3:
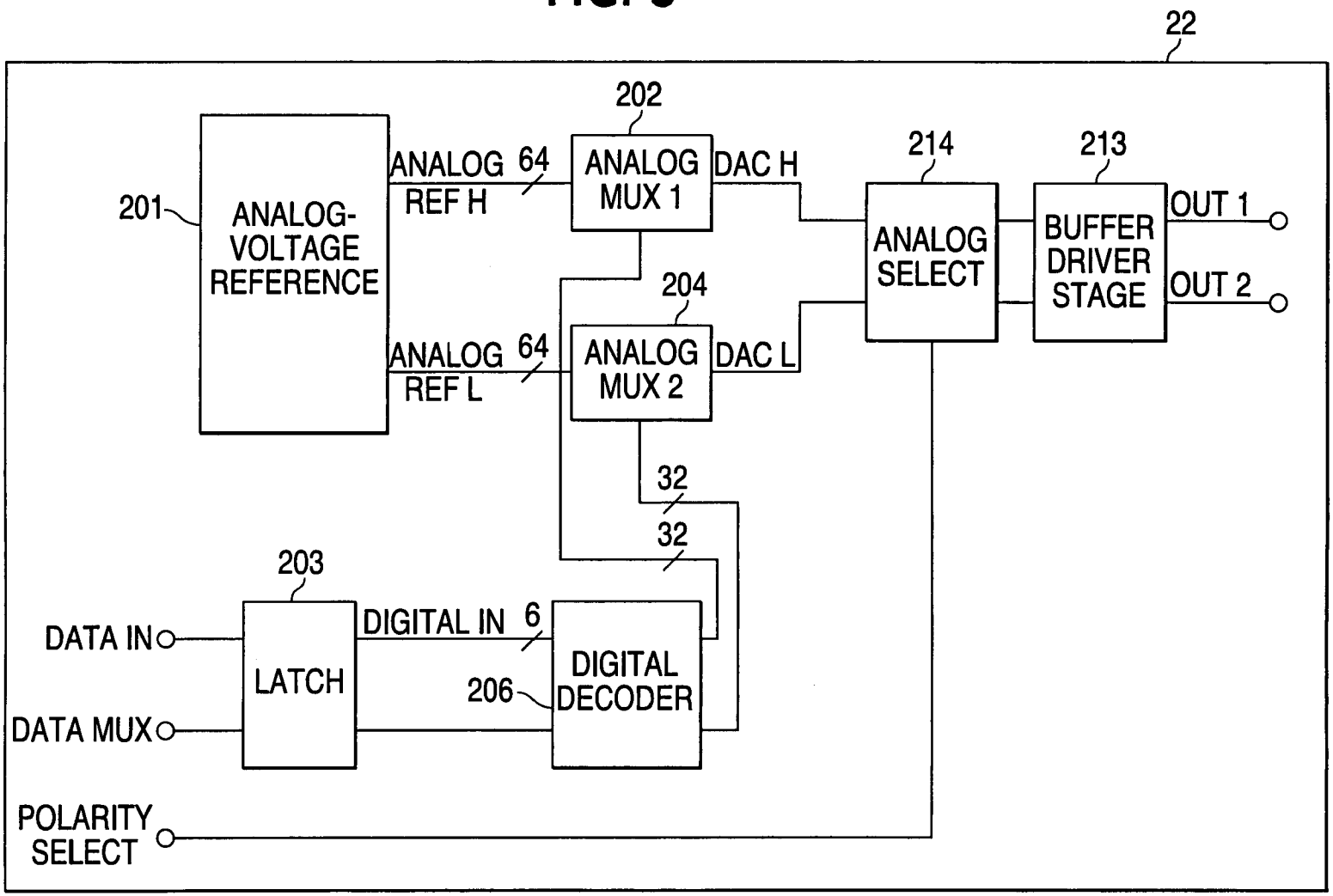
FIG. 3 illustrates a block diagram of a representative column driver circuit in another embodiment of the present invention.

FIG. 3 illustrates a representative column driver circuit in another embodiment of the present invention. As illustrated in FIG. 3, representative column driver 22 comprises an analog voltage reference circuit 201. Analog voltage reference circuit 201 provides a series of reference voltage levels. In an embodiment, analog voltage reference circuit 201 comprises a string of resistive elements connected in series, or "resistive string." However, as will be readily appreciated by those of ordinary skill in the art, other techniques for providing analog reference voltage levels may be used in other embodiments according to the present invention. The reference voltage levels are input to one or more data decoder circuits 202 and 204. Data decoder circuits 202 and 204 are 64:1 analog multiplexers in an embodiment. In alternative embodiments, other topologies can also be used. Each of data decoders 202 and 204 receives a subset of the reference voltage levels from analog voltage reference circuit 201. For example, data decoder 202 receives a high polarity subset of the reference voltage levels, and data decoder 204 receives a low polarity subset of the reference voltage levels.

Digital data input to column driver circuit 22 is latched by a digital latch 203. The latched digital data are provided to a digital decoder 206. Digital decoder 206 is coupled to data decoders 202 and 204. Digital decoder 206 functions to select an appropriate analog voltage from the reference voltage levels input to data decoders 202 and 204 to provide analog outputs DACH and DACL. Analog outputs are provided to an analog selection circuit 214, which selects one output from data decoders 202 and 204 at the input to an amplifier (buffer driver) stage 213. The output from amplifier stage 213 drives the columns of the display at opposite polarities.

Figure 4:
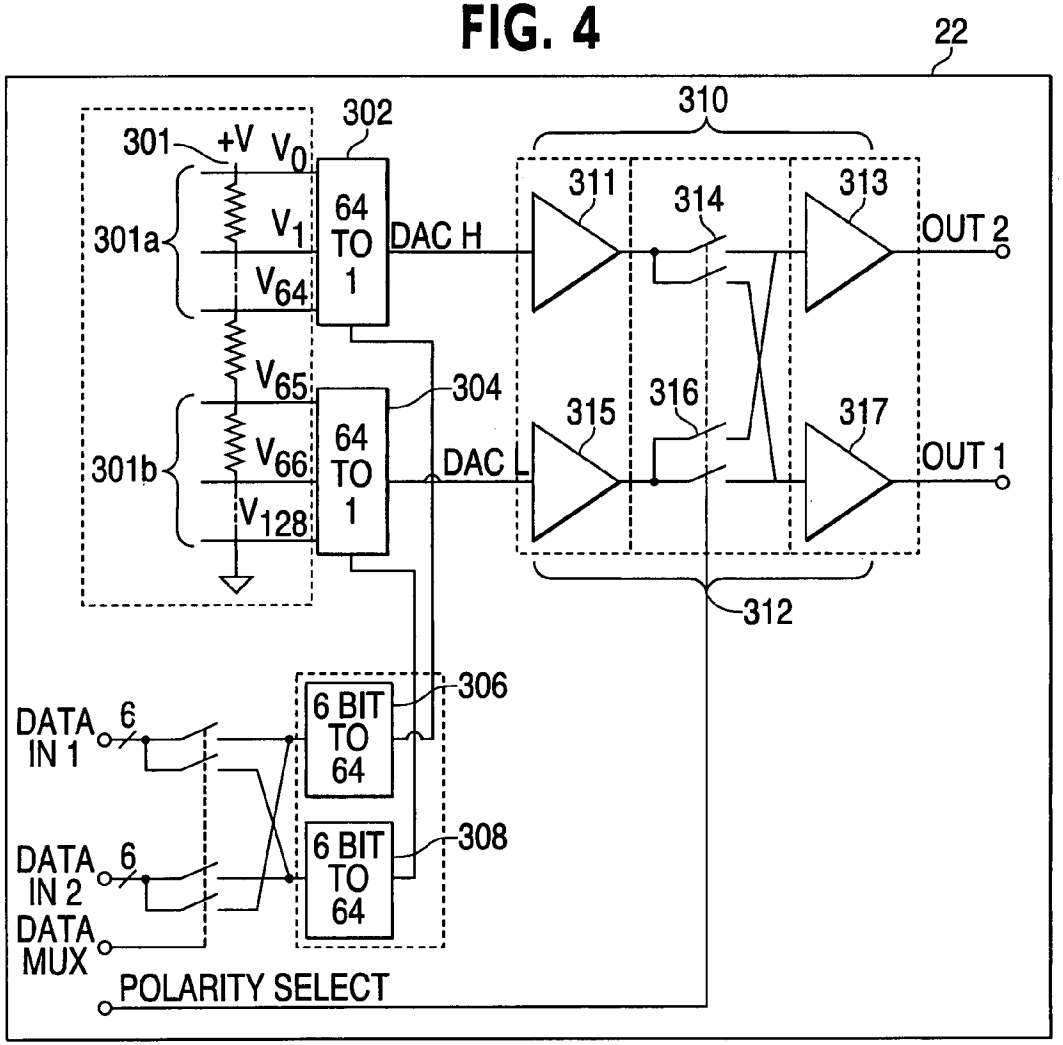
FIG. 4 illustrates a drawing of a representative column driver circuit in an embodiment of the present invention.

FIG. 4 illustrates a representative column driver circuit in an embodiment of the present invention. As illustrated in FIG. 4, column driver circuit 22 comprises data decoders 302 and 304. In the exemplary embodiment illustrated by FIG. 4, data decoders 302 and 304 are two 64:1 analog multiplexers. Each of data decoders 302 and 304 receives a subset of the reference voltage levels. For example, data decoder 302 receives a high polarity subset of the reference voltage levels $V_1 \ldots V_{64}$, ranging from 0 volt to +5 volts. Accordingly, data decoder 304 receives a low polarity subset of reference voltage levels $V_{65} \ldots V_{128}$, ranging from 0 volt to −5 volts. The reference voltage levels may be provided by a variety of sources, but in one presently preferred embodiment, these voltage levels are provided by a resistive string that functions as a voltage divider 301. Voltage divider 301 includes a first portion 301 a for generating the high polarity subset of reference voltage levels $V_1 \ldots V_{64}$, and a second portion 301*b* for generating the low polarity subset of reference voltage levels $V_{65} \ldots V_{128}$.

Latch 103 referenced in FIG. 2 may include digital decoders 306 and 308 to provide the capability to select one of the reference voltage levels in each of data decoders 302 and 304 in order to provide outputs. Digital decoders 306 and 308 are 6:64 digital decoders. Data decoders 302 and 304 are coupled to two-stage amplifiers 310 and 312, respective. Each of two stage amplifiers 310 and 312 has a first stage that receives the output of one of data decoders 302 and 304, and a second stage that receives the output of the first stage and provides an output signal for driving a column of the display.

Amplifier 310 comprises a first stage amplifier 311 and a second stage amplifier 313, and amplifier 312 comprises a first stage amplifier 315 and a second stage amplifier 317. A plurality of controllable analog switches 314 and 316 are interposed between first stage amplifiers 311 and 315 and second stage amplifiers 313 and 317, respectively, of two stage amplifiers 310 and 312. Analog switches 314 and 316 provide a selection of one of the outputs from first stage amplifiers 311 and 315 of amplifiers 310 and 312 to one of second stages amplifiers 313 and 317 of amplifiers 310 and 312. This enables voltages of opposite polarities to be placed on alternating columns of the display.

Figure 5:
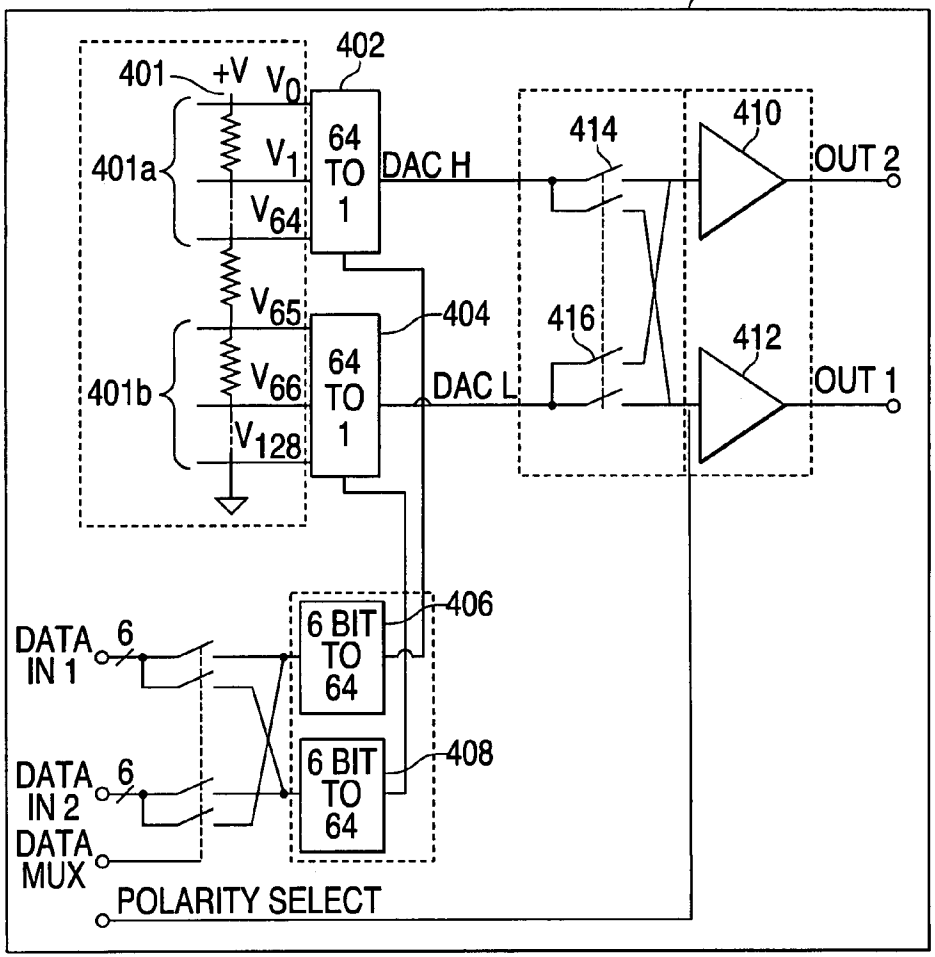
FIG. 5 illustrates a drawing of a representative column driver circuit in another embodiment of the present invention.

FIG. 5 illustrates a representative column driver circuit in another embodiment of the present invention. Column driver circuit 22 comprises data decoders 402 and 404. In the exemplary embodiment, data decoders 402 and 404 are two 64:1 analog decoders. Each of data decoders 402 and 404 receives a subset of the reference voltage levels. For example, data decoder 402 receives a high polarity subset of reference the voltage levels $V_{129} \ldots V_{192}$, ranging from 0 volt to +5 volts. Accordingly, data decoder 404 receives a low polarity subset of reference voltage levels $V_{193} \ldots V_{256}$, ranging from 0 volt to −5 volts. The reference voltage levels may be provided by a variety of sources, but in one presently preferred embodiment, these voltage levels are provided by a resistive string that functions as a voltage divider 401. Voltage divider 401 includes a first portion 401*a* for generating the high polarity subset of reference voltage levels $V_{129} \ldots V_{192}$, and a second portion 401*b* for generating the low polarity subset of reference voltage levels $V_{193} \ldots V_{256}$.

Latch 103 referenced in FIG. 2 may include digital decoders 406 and 408 to provide the capability to select one of the reference voltage levels in each of data decoders 402 and 404 in order to provide outputs. Digital decoders 406 and 408 are 6:64 digital decoders. Data decoders 402 and 404 are coupled to single stage amplifiers 410 and 412, respectively. Each of single stage amplifiers 410 and 412 buffers the output voltage of the selected data decoder. Each amplifier has a full range single stage that receives the output of one of data decoders 402 and 404, and provides an output signal for driving a column of the display. Controllable analog switches 414 and 416 are interposed between data decoders 402 and 404 and amplifiers 410 and 412. Analog switches 414 and 416 provide a selection of one of the outputs from data decoders 402 and 404 to amplifiers 410 and 412. This enables voltages of opposite polarities to be placed on alternating columns of the display.

Figure 6:
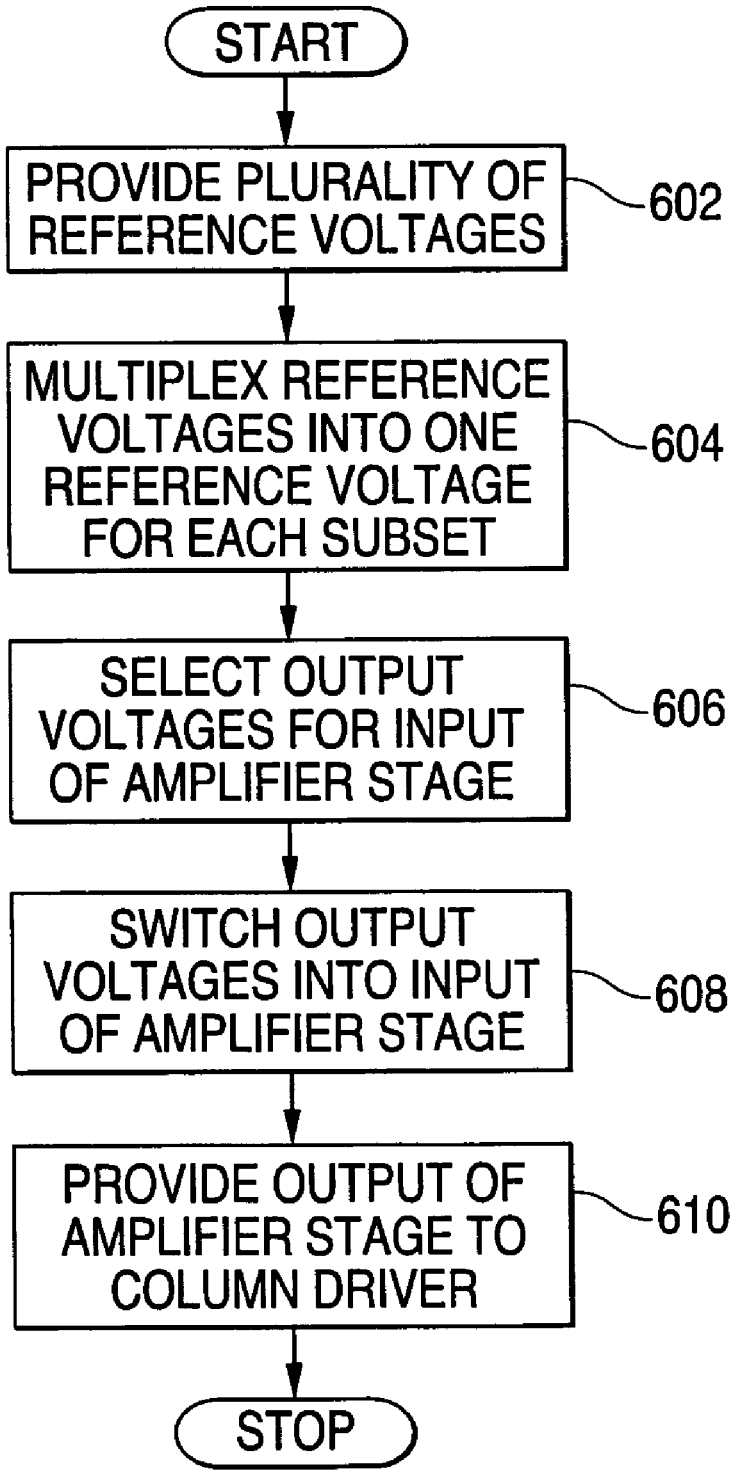
FIG. 6 illustrates a flowchart of a representative method for driving a display in an embodiment of the present invention.

FIG. 6 illustrates a flowchart of a representative method for driving a display in an embodiment of the present invention. As illustrated in FIG. 8, in a step 602, a plurality of reference voltage levels is provided. The reference voltage levels are divided into two or more subsets. Then, in a step 604, the reference voltage levels are multiplexed into a plurality of output voltages, one output voltage for each subset. Next, two of the plurality of output voltages are selected based upon an input at a step 606. Then, in a step 608, the output voltages are then switched into the inputs of a plurality of amplifiers. In a step 610, an output of the amplifiers is provided as an output voltage. In an embodiment, switching the output voltage into the input of a plurality of amplifiers comprises switching an output of a pre-amplified output voltage into inputs of a final amplification stage. In another embodiment, switching the output voltage into the input into a plurality of amplifiers comprises switching the output voltage prior to input into the plurality of amplifiers.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A column driver circuit, comprising:

a voltage divider for generating a plurality of reference voltage levels;

a first data decoder coupled to said voltage divider for receiving a first subset of said plurality of reference voltage levels;

a second data decoder coupled to said voltage divider for receiving a second subset of said plurality of reference voltage levels;

a plurality of digital decoders coupled to said first and second data decoders, operable to select one of said plurality of reference voltage levels for each of said first and second data decoders each to provide at least one analog output;

a plurality of amplifiers, each having a first stage that receives said analog output from one of said plurality of data decoders, and a second stage that receives as input an output of said first stage and provides a signal; and a plurality of switches, each coupled between said first stage and said second stage of each of said plurality of two stage amplifiers, wherein one of said switches couples one of said output from one of said first stage of one of said amplifiers to one of said second stage of one of said amplifiers.

2. The column driver circuit of claim 1, wherein at least one of said data decoders comprises one 64 input to 1 output multiplexer.

3. The column driver circuit of claim 1, wherein at least one of said digital decoders comprises one 6 input to 64 output digital demultiplexer.

4. The column driver circuit of claim 1, wherein said first stage of said amplifier is operable to provide half of an output voltage range.

5. The column driver circuit of claim 1, wherein said second stage of said amplifier is operable to provide an entire amount of an output voltage range.

6. A liquid crystal display, comprising:

a plurality of columns of pixels;

a plurality of rows of pixels; and a plurality of column driver circuits, each coupled to one of said plurality of pixels, each column driver circuit including, a voltage divider for generating a plurality of reference voltage levels, a first data decoder coupled to said voltage divider for receiving a first subset of said plurality of reference voltage levels, a second data decoder coupled to said voltage divider for receiving a second subset of said plurality of reference voltage levels, at least one digital decoder coupled to said first and second data decoders, operable to select one of said plurality of reference voltage levels for each of said first and second data decoders each to provide at least one analog output, and at least one switch, each of said at least one switch coupled between at least one of said data decoders and at least one amplifier, wherein said at least one switch provides a selection of one of said outputs from at least one of said first and second of data decoders to said at least one amplifier, wherein each of said at least one amplifier has a stage that receives as input said output from one of said first and second data decoders, and provides a signal.

7. The liquid crystal display of claim 6, wherein said data decoders comprise 64 input to 1 output multiplexers.

8. The liquid crystal display of claim 6, wherein said digital decoders comprise 6 input to 64 output digital demultiplexers.

9. The liquid crystal display of claim 6, wherein said at least one amplifier is operable to provide an entire amount of an output voltage range.

* * * * *